US006206740B1

(12) United States Patent
Sholler

(10) Patent No.: US 6,206,740 B1
(45) Date of Patent: Mar. 27, 2001

(54) INBOARD MARINE ENGINE WINTERIZING APPARATUS

(76) Inventor: Kevin P. Sholler, 30782 Avondale, Westland, MI (US) 48186

( * ) Notice: Subject to any disclaimer, the term of this patent is extended or adjusted under 35 U.S.C. 154(b) by 0 days.

(21) Appl. No.: 09/470,753

(22) Filed: Dec. 23, 1999

(51) Int. Cl.[7] ..... B63H 21/10
(52) U.S. Cl. ..... 440/88; 134/169 A
(58) Field of Search ..... 440/88, 113; 123/41.14; 134/95, 169 F; 165/95

(56) References Cited

U.S. PATENT DOCUMENTS

| | | | | |
|---|---|---|---|---|
| D. 307,172 | | 4/1990 | Downing . | |
| 1,962,932 | | 6/1934 | Mather, Jr. . | |
| 4,619,618 | | 10/1986 | Patti . | |
| 5,263,885 | | 11/1993 | Montague . | |
| 5,337,774 | * | 8/1994 | Boyd | 440/113 |
| 5,393,252 | | 2/1995 | Brogdon . | |
| 5,618,214 | * | 4/1997 | Wyss et al. | 440/88 |
| 5,725,403 | * | 3/1998 | Ridolfo | 440/88 |

* cited by examiner

*Primary Examiner*—Jesus D. Sotelo

(57) ABSTRACT

A inboard marine engine winterizing apparatus for drawing antifreeze solution in a marine engine for winter storage. The inboard marine engine winterizing apparatus includes includes a container having a side wall, a slanted upper floor, a lower floor, an open top, a first and second compartments therein, a first opening into the first compartment and being closeable with a plug member, a second opening into the second compartment and being closeable with a plug member, and further includes a handle member moveably and securely attached to the container, a lid member closeable over the open end of the container; and also includes a pipe member having a threaded first end which is threaded into the first opening, a valve member disposed in the pipe member for controlling the flow of liquid from the first compartment, a hose coupling member having a water control valve member and being intergally attached to the pipe member and extending therefrom, a second end, and a flexible tubular member removeably mounted upon the second end.

14 Claims, 2 Drawing Sheets

INBOARD MARINE ENGINE WINTERIZING APPARATUS

BACKGROUND OF THE INVENTION

1. Field of the Invention

The present invention relates to a boat engine winterizing kit and more particularly pertains to a new inboard marine engine winterizing apparatus for drawing antifreeze solution in a marine engine for winter storage.

2. Description of the Prior Art

The use of boat engine winterizing kit is known in the prior art. More specifically, boat engine winterizing kit heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,263,885; U.S. Pat. No. 5,035,208; U.S. Pat. No. 1,962,932; U.S. Pat. No. 5,393,252; U.S. Pat. No. 4,619,618; and U.S. Pat. No. Des. 307,172.

While these devices fulfill their respective, particular objectives and requirements, the aforementioned patents do not disclose a new inboard marine engine winterizing apparatus. The inventive device includes a container having a side wall, a slanted upper floor, a lower floor, an open top, a first and second compartments therein, a first opening into the first compartment and being closeable with a plug member, a second opening into the second compartment and being closeable with a plug member, and further includes a handle member moveably and securely attached to the container, a lid member closeable over the open end of the container; and also includes a pipe member having a threaded first end which is threaded into the first opening, a valve member disposed in the pipe member for controlling the flow of liquid from the first compartment, a hose coupling member having a water control valve member and being intergally attached to the pipe member and extending therefrom, a second end, and a flexible tubular member removeably mounted upon the second end.

In these respects, the inboard marine engine winterizing apparatus according to the present invention substantially departs from the conventional concepts and designs of the prior art, and in so doing provides an apparatus primarily developed for the purpose of drawing antifreeze solution in a marine engine for winter storage.

SUMMARY OF THE INVENTION

In view of the foregoing disadvantages inherent in the known types of boat engine winterizing kit now present in the prior art, the present invention provides a new inboard marine engine winterizing apparatus construction wherein the same can be utilized for drawing antifreeze solution in a marine engine for winter storage.

The general purpose of the present invention, which will be described subsequently in greater detail, is to provide a new inboard marine engine winterizing apparatus which has many of the advantages of the boat engine winterizing kit mentioned heretofore and many novel features that result in a new inboard marine engine winterizing apparatus which is not anticipated, rendered obvious, suggested, or even implied by any of the prior art boat engine winterizing kit, either alone or in any combination thereof.

To attain this, the present invention generally comprises includes a container having a side wall, a slanted upper floor, a lower floor, an open top, a first and second compartments therein, a first opening into the first compartment and being closeable with a plug member, a second opening into the second compartment and being closeable with a plug member, and further includes a handle member moveably and securely attached to the container, a lid member closeable over the open end of the container; and also includes a pipe member having a threaded first end which is threaded into the first opening, a valve member disposed in the pipe member for controlling the flow of liquid from the first compartment, a hose coupling member having a water control valve member and being intergally attached to the pipe member and extending therefrom, a second end, and a flexible tubular member removeably mounted upon the second end.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inboard marine engine winterizing apparatus which has many of the advantages of the boat engine winterizing kit mentioned heretofore and many novel features that result in a new inboard marine engine winterizing apparatus which is not anticipated, rendered obvious, suggested, or even implied by any of the prior art boat engine winterizing kit, either alone or in any combination thereof.

It is another object of the present invention to provide a new inboard marine engine winterizing apparatus which may be easily and efficiently manufactured and marketed.

It is a further object of the present invention to provide a new inboard marine engine winterizing apparatus which is of a durable and reliable construction.

An even further object of the present invention is to provide a new inboard marine engine winterizing apparatus which is susceptible of a low cost of manufacture with regard to both materials and labor, and which accordingly is then susceptible of low prices of sale to the consuming public, thereby making such inboard marine engine winterizing apparatus economically available to the buying public.

Still yet another object of the present invention is to provide a new inboard marine engine winterizing apparatus which provides in the apparatuses and methods of the prior art some of the advantages thereof, while simultaneously overcoming some of the disadvantages normally associated therewith.

Still another object of the present invention is to provide a new inboard marine engine winterizing apparatus for drawing antifreeze solution in a marine engine for winter storage.

Yet another object of the present invention is to provide a new inboard marine engine winterizing apparatus which includes includes a container having a side wall, a slanted upper floor, a lower floor, an open top, a first and second compartments therein, a first opening into the first compartment and being closeable with a plug member, a second opening into the second compartment and being closeable with a plug member, and further includes a handle member moveably and securely attached to the container, a lid member closeable over the open end of the container; and also includes a pipe member having a threaded first end which is threaded into the first opening, a valve member disposed in the pipe member for controlling the flow of liquid from the first compartment, a hose coupling member having a water control valve member and being intergally attached to the pipe member and extending therefrom, a second end, and a flexible tubular member removeably mounted upon the second end.

Still yet another object of the present invention is to provide a new inboard marine engine winterizing apparatus that allows the user to more quickly winterize the marine engine without having to remove the engine plugs and hoses.

Even still another object of the present invention is to provide a new inboard marine engine winterizing apparatus that is portable and can be easily stored.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
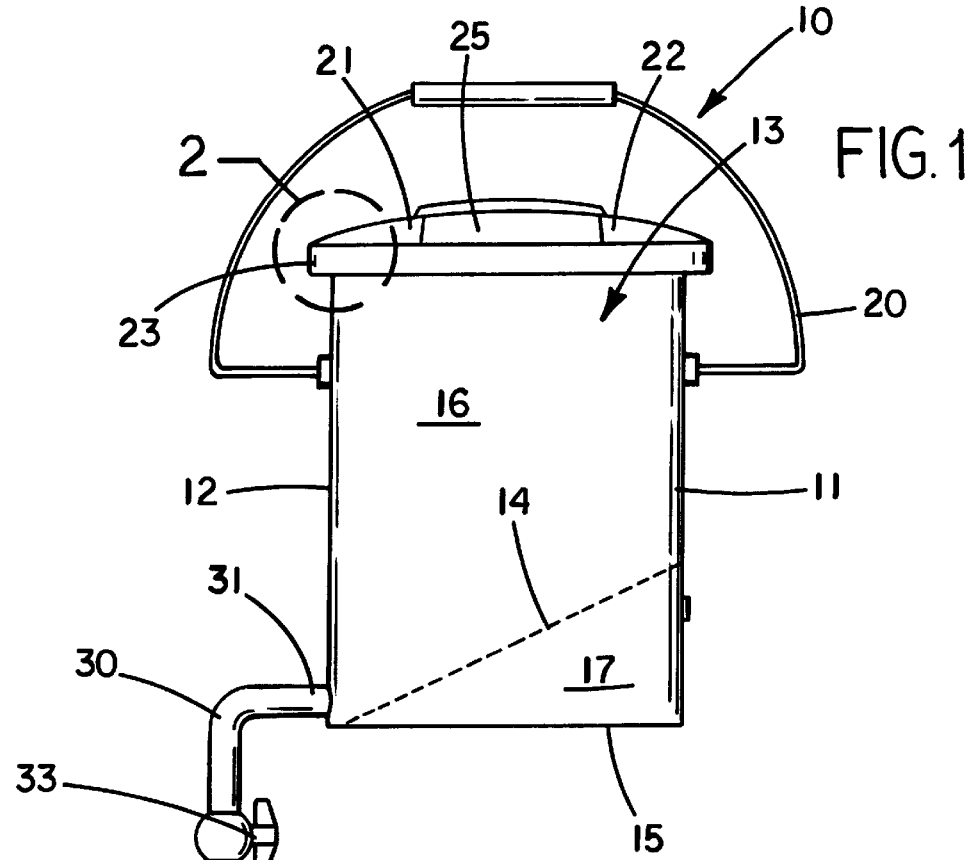
FIG. 1 is a side elevational view of a new inboard marine engine wintering apparatus according to the present invention.
Figure 2:
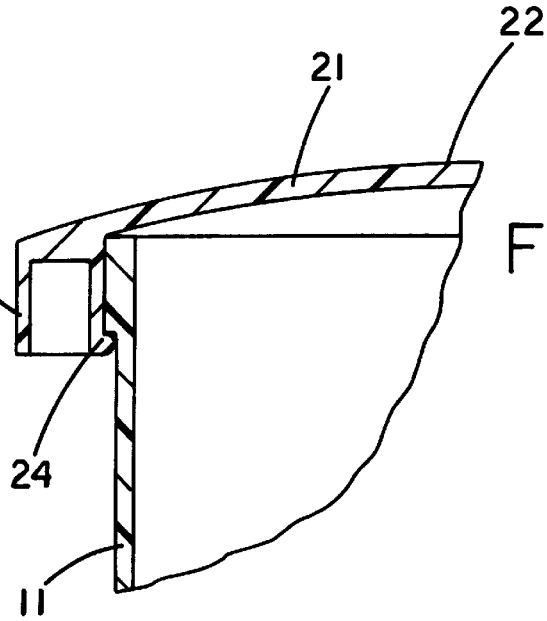
FIG. 2 is a detailed cross-sectional view of the container and lid member of the present invention.
Figure 3:
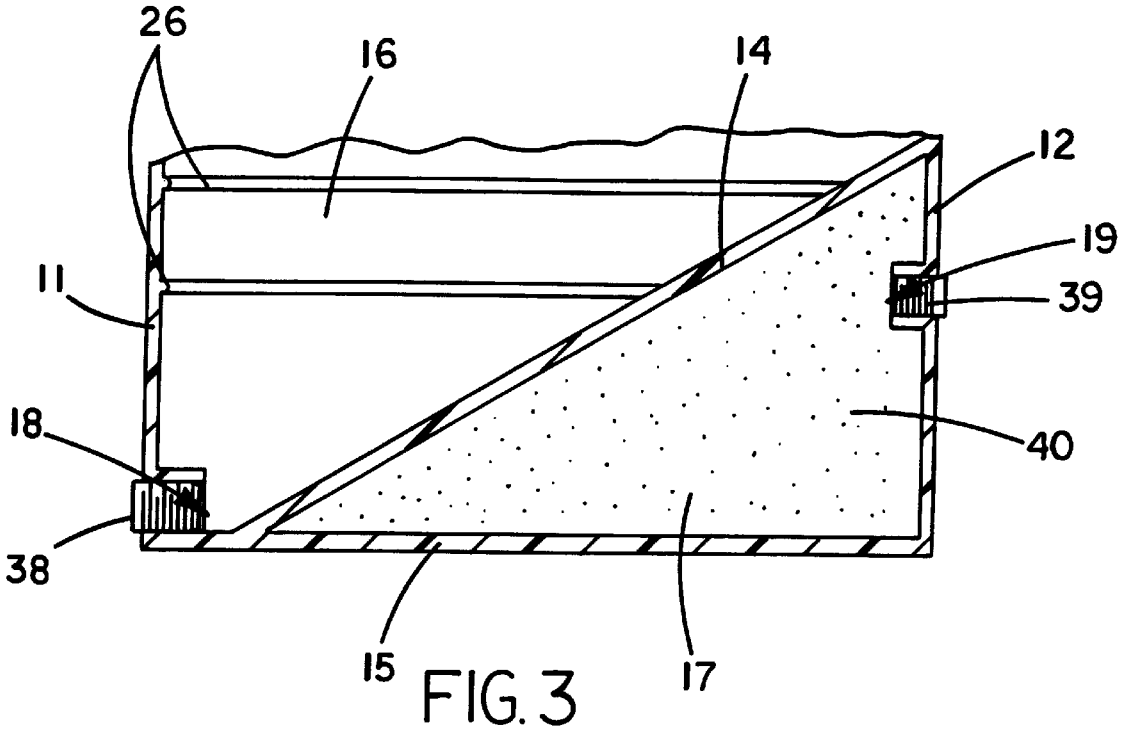
FIG. 3 is a detailed cross-sectional view of the upper and lower floors of the container of the present invention.

With reference now to the drawings, and in particular to FIGS. 1 through 3 thereof, a new inboard marine engine winterizing apparatus embodying the principles and concepts of the present invention and generally designated by the reference numeral 10 will be described.

As best illustrated in FIGS. 1 through 3, the inboard marine engine winterizing apparatus 10 generally comprises a container 11 having a first 16 and second 17 compartments, an open top 13, a side wall 12, a slanted upper floor 14, a lower floor 15, a first opening 18 extending through the side wall 12 into the first compartment 16 and being closeable with a first plug member 18, and a second opening 19 extending through the side wall 12 into the second compartment 17 and being closeable with a second plug member 19. The upper floor 14 separates the compartments 16,17. The container 11 including a plurality of rib-like members 26 spaced along and being securely and integrally attached to an interior of the side wall 12 inside the first compartment 16 for indicating amount of liquid contained therein. The rib-like members 26 are spaced from near the lower floor 17 to near the open top 13. The container 11 includes a rim extending about the open top 13 thereof with the first compartment 16 being adapted to receive and store liquid therein, and the second compartment 17 being adapted to receive and store a weighted substance 40 to essentially counter the weight of the liquid in the first compartment 16. The weighted substance 40 is received through the second opening 19 and is essentially sand. A handle member 20 is securely and moveably attached to the side wall 12 of the container 11. A lid member 21 is removeably secureable over the open top 13 of the container 11. A means for dispensing liquid from the container 11 through the first opening 18 includes a pipe member 30 having a first end 31 removeably threaded into the first opening 18, an open second end 32, a valve member 33 disposed in the pipe member 30 intermediate of the first end 31 and the second end 32 for controlling the flow of liquid through the first opening 18, and further includes a hose coupling member 34 integrally attached to the pipe member 30 and extending outwardly therefrom and having a threaded end portion 35 for attaching to a hose and further having a water control valve member 36 disposed in the hose coupling member 34, and a flexible tubular member 37 removeably mounted about the second end 32 for connecting to a water pick-up line of an engine. The pipe member 30 includes an elbow portion near the first end 31 thereof.

As a first embodiment of the inboard marine engine winterizing apparatus 10, the lid member 21 includes a top wall 22 groove in the top wall 25, a side wall 23 depending from a perimeter of the top wall 22, and a flanged portion 24 integrally attached to the side wall 23 and extending inwardly of the lid member 21 for removeably fastening to the container 11 over the top end 13 thereof.

As a second embodiment of the inboard marine engine winterizing apparatus 10, the lid member 21 includes a top wall 22, a groove 25 in the top wall 22, a side wall 23 depending from a perimeter of the top wall 23 with the lid member 21 being removeably threaded upon the container 11 over top end 13 thereof.

In use, the flexible tubular member 37 would be connected to a water pick-up line of an engine and water would be provided through the hose coupling member 34 until the engine is warmed up. After that, the water control valve member 36 would be turned off and the valve member 33 would be opened to allow antifreeze from the first compartment 16 to enter the water take-up line of the engine.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inboard marine engine winterizing apparatus comprising:

a container having a first and second compartments, an open top, at least one side wall, an upper floor, a lower floor, a first opening extending through said at least one side wall into said first compartment and being closeable with a first plug member, and a second opening extending through said at least one side wall in said second compartment and being closeable with a second plug member, said upper floor separating said compartments;

a handle member securely and moveably attached to said at least one side wall of said container;

a lid member removeably secureable over said open top of said container; and a means for dispensing liquid from said container through said first opening.

2. An inboard marine engine winterizing apparatus as described in claim 1, wherein said container includes a plurality of rib-like members spaced along and securely attached to an interior of said at least one side wall inside said first compartment for indicating amount of liquid contained therein.

3. An inboard marine engine winterizing apparatus as described in claim 2, wherein said rib-like members are spaced from near said lower floor to near said open top.

4. An inboard marine engine winterizing apparatus as described in claim 3, which said container includes a rim extending about said open top thereof.

5. An inboard marine engine winterizing apparatus as described in claim 4, wherein said lid member includes a top wall, a groove in said top wall, at least one side wall depending from a perimeter of said top wall, and a flanged portion integrally attached to said at least one side wall and extending inwardly of said lid member for removeably fastening to said container over said top end thereof.

6. An inboard marine engine winterizing apparatus as described in claim 3, wherein said lid member includes a top wall, a groove in said top wall, at least one side wall depending from a perimeter of said top wall, said lid member being removeably threaded upon said container over top end thereof.

7. An inboard marine engine winterizing apparatus as described in claim 1, wherein said means for dispensing liquid from said container includes a pipe member having a first end removeably threaded into said first opening, an open second end, a valve member disposed in said pipe member intermediate of said first end and said second end for controlling flow of liquid from said first compartment, a hose coupling member integrally attached to said pipe member and extending outwardly therefrom and having a threaded end portion and a water control valve member disposed therein, and a flexible tubular member removeably mounted about said second end for connecting to a water pick-up line of an engine.

8. An inboard marine engine winterizing apparatus as described in claim 7, wherein said pipe member includes an elbow portion near said first end thereof.

9. An inboard marine engine winterizing apparatus as described in claim 1, wherein said first compartment is adapted to receive and store liquid therein.

10. An inboard marine engine winterizing apparatus as described in claim 9, wherein said second compartment is adapted to receive and store a weighted substance to essentially counter the weight of the liquid in said first compartment, the weighted substance being received through said second opening.

11. An inboard marine engine winterizing apparatus as described in claim 10, wherein said weighted substance is essentially sand.

12. An inboard marine engine winterizing apparatus comprising:

a container having a first and second compartments, an open top, at least one side wall, an upper floor, a lower floor, a first opening extending through said at least one side wall into said first compartment and being closeable with a first plug member, and a second opening extending through said at least one side wall in said second compartment and being closeable with a second plug member, said upper floor separating said compartments, said container including a plurality of rib-like members spaced along and being securely attached to an interior of said at least one side wall inside said first compartment for indicating amount of liquid contained therein, said rib-like members being spaced from near said lower floor to near said open top, said container including a rim extending about said open top thereof, said first compartment being adapted to receive and store liquid therein, said second compartment being adapted to receive and store a weighted substance to essentially counter the weight of the liquid in said first compartment, said weighted substance being received through said second opening, said weighted substance being essentially sand;

a handle member securely and moveably attached to said at least one side wall of said container;

a lid member removeably secureable over said open top of said container; and a means for dispensing liquid from said container through said first opening including a pipe member having a first end removeably threaded into said first opening, an open second end, a valve member disposed in said pipe member intermediate of said first end and said second end for controlling flow of liquid from said first compartment, a hose coupling member integrally attached to said pipe member and extending outwardly therefrom and having a threaded end portion and a water control valve member disposed therein, and a flexible tubular member removeably mounted about said second end for connecting to a water pick-up line of an engine, said pipe member including an elbow portion near said first end thereof.

13. An inboard marine engine winterizing apparatus as described in claim 12, wherein said lid member includes a top wall, a groove in said top wall, at least one side wall depending from a perimeter of said top wall, and a flanged portion integrally attached to said at least one side wall and extending inwardly of said lid member for removeably fastening to said container over said top end thereof.

14. An inboard marine engine winterizing apparatus as described in claim 12, wherein said lid member includes a top wall, a groove in said top wall, at least one side wall depending from a perimeter of said top wall, said lid member being removeably threaded upon said container over top end thereof.

* * * * *